United States Patent [19]

Schukey

[11] Patent Number: 4,938,668

[45] Date of Patent: Jul. 3, 1990

[54] ROTATING PISTON MACHINE

[76] Inventor: Jürgen Schukey, Schnackenburgallee 173b, Hamburg 54, Fed. Rep. of Germany

[21] Appl. No.: 299,808

[22] PCT Filed: Jul. 22, 1987

[86] PCT No.: PCT/EP87/00401

§ 371 Date: Jan. 10, 1989

§ 102(e) Date: Jan. 10, 1989

[87] PCT Pub. No.: WO88/00641

PCT Pub. Date: Jan. 28, 1988

[30] Foreign Application Priority Data

Jul. 23, 1986 [DE] Fed. Rep. of Germany ..... 3624842

[51] Int. Cl.[5] ..... F04C 5/00; F04C 2/324

[52] U.S. Cl. ..... 418/38; 418/156; 418/157

[58] Field of Search ..... 418/38, 156, 157

[56] References Cited

U.S. PATENT DOCUMENTS 1,458,950 2/1920 Poirmeur ..... 418/38
1,874,308 10/1928 Kolko ..... 418/38
1,920,201 10/1930 Kolko ..... 418/38
1,950,228 4/1931 Dedieu ..... 418/38

FOREIGN PATENT DOCUMENTS 2032631 11/1970 France .

*Primary Examiner*—Michael Koczo
*Assistant Examiner*—John A. Savio, III
*Attorney, Agent, or Firm*—Chilton, Alix & Van Kirk

[57] ABSTRACT

A rotating piston machine has a casing 2 with a shaft 5 borne in the casing 2. In an annular space 1 there are arranged rotating elements which bear in sealing manner against the walls of the annular space 1. Each rotating element (3, 4) has four outwardly extending sector-shaped vanes (*3a–3d, 4a–4d*). The two rotating elements (3, 4) are arranged coaxially; their vanes (*3a–3d, 4a–4d*) engage in one another, so that in each case one vane of the one rotating element is arranged between two vanes of the other rotating element. By a cam track control it is achieved that, on rotation of the shaft 5, both rotating elements execute rotations with cyclic changes in the speed of rotation and the distances between the vanes (*3a–3d, 4a–4d*). The cam track control has in this case for each rotating element eight rolling elements which interact with an inner and an outer curved track non-positively and free from play.

20 Claims, 10 Drawing Sheets

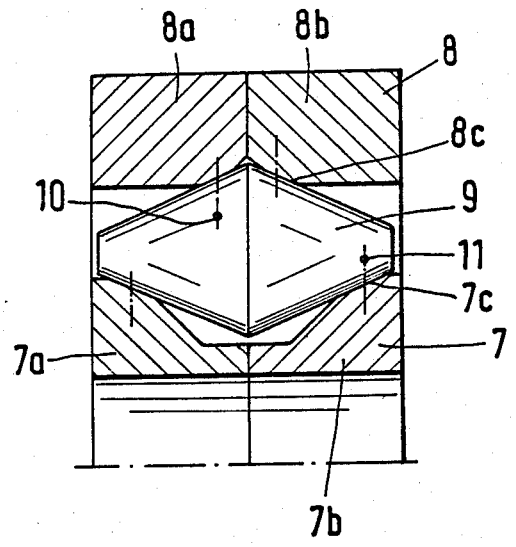
Fig.4
Fig.5
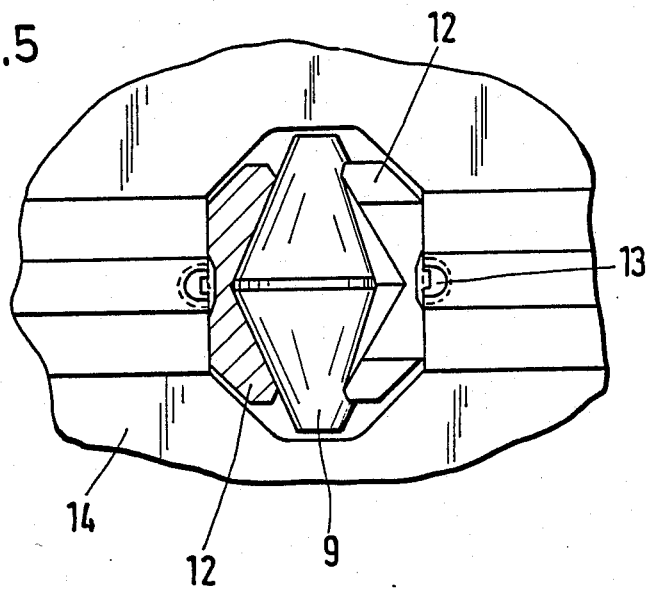

Fig.10a
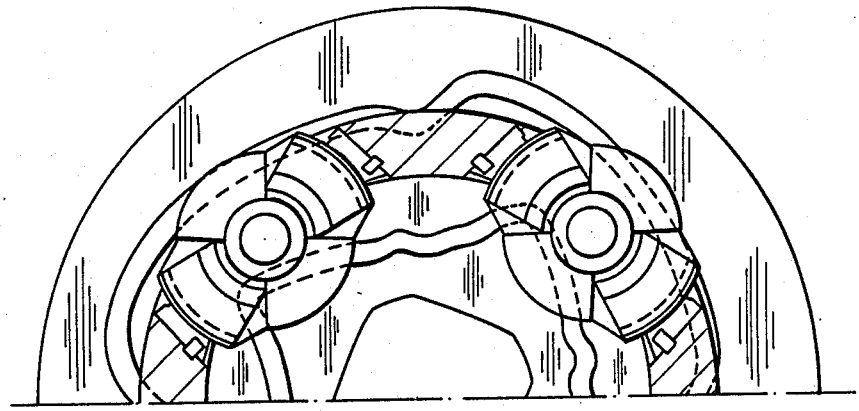
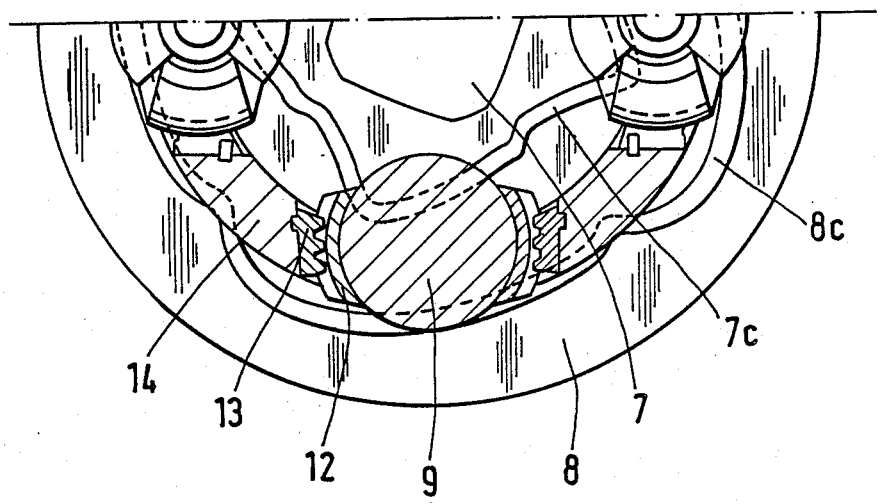
Fig.10b

ROTATING PISTON MACHINE

The invention relates to a rotating piston machine with a casing, with a shaft borne in the casing, with an annular space, in which two rotating elements are arranged and against the walls of which, in which intake and discharge openings for the working medium are provided, the rotating elements bear in sealing manner, each rotating element having four radially outwardly extending sector-shaped vanes, the two rotating elements being arranged coaxially and their vanes engaging in one another in such a way that in each case one vane of the one rotating element is arranged between two vanes of the other rotating element, a cam track control being provided, by which, on rotation of the shaft, both rotating elements execute rotations with cyclic changes in the speed of rotation and in the distances between the vanes of the two rotating elements, and the cam track control having inner cam rings which are connected fixedly in terms of rotation to the shaft.

Various rotating piston machines are known, which all have, however, various disadvantages. In particular, the problem of balance frequently occurs, so that the known rotating piston machines frequently run very out of round, which on the one hand causes vibration and noise, and on the other hand also subjects the bearings to very high stresses.

Various disadvantages also occur in the case of a known rotating piston machine of the type mentioned in British Patent Specification No. 299,767. As can be convincingly deduced from simple geometrical considerations, the guidance of the rolling elements between the inner cam track and the outer rollers cannot take place there without play. This is not possible with any cam geometry of the inner cam track. The force transmission via the variously borne rollers is very small, so that only a low efficiency can be achieved which is out of all proportion to the moved masses. No interaction takes place in the region of the load changes, that is to say the reversal points of the cam track; there are dead points there. The bearing of the rollers is not described and obviously not solved. Owing to the said problems, it must be expected that a rotating piston machine corresponding to the citation would run at least very unevenly and have a low efficiency.

The object consists in creating a rotating piston machine which operates very effectively and with which essentially no problems due to uneven running occur.

The solution according to the invention consists in that the cam track control has outer cam rings which are connected fixedly in terms of rotation to one rotating element, that in each case four of the rolling elements roll between one inner cam ring and one outer cam ring each, and rolling elements which are displaceable in radial direction, held undisplaceably in circumferential direction by a cage connected to the casing, and that two pairs of inner/outer cam rings per rotating element are provided with corresponding rolling elements.

By the cam track control according to the invention, the two rotating elements can be set in motion in such a way that, on their rotation, the volume of the working spaces on both their sides is changed cyclically in accordance with intake and discharge openings, so that the desired mode of operation is achieved.

The force transmission takes place in this case by the shortest route in each case via two cam track surfaces.

The flux of force is ensured at every point of the cam track. Play-free running is also ensured. The cam geometry can in this case be designed in such a way that uniform acceleration values are achieved, as a result of which the acceleration torque can be reduced.

Eight rolling elements per rotating element are constantly active and free from play. The force transmission takes place both by lifting work of the rolling elements and by traction between the cam tracks and the rolling elements (i.e. rolling of the rolling elements on the cam tracks).

The rotating piston machine can in this case serve, on the one hand, as a compressor, for example for gases. It can, however, also operate as an engine if the compressed gases are allowed to flow into a separate combustion chamber, have fuel admitted to them there and if this mixture is ignited and the gases subsequently are conducted back into the annular working space in order for them to drive the rotating elements.

If the shaft rotates, and consequently the inner cam ring connected to it fixedly in terms of rotation, said cam ring will push the rolling element outwards when its rolling surface for the rolling element goes outwards in radial direction upon this rotation. As a result, the outer cam ring is indirectly set in rotation since it has to give way in such a way that the rolling element finds a position in which the rolling track lies radially further outwards on the outer cam ring. In this way, the rotational movement of the shaft is transmitted to the outer cam ring and thus to the rotating element. The speed and the variation of this speed are determined in this case by the shape of the track curves on the cam rings. Once the rolling elements have reached the outer-most position, they cannot transmit a torque any longer from the inner cam ring to the outer cam ring. The movement is then continued by the second set of inner/outer cam rings until the first set of inner/outer cam rings can again transmit torque.

It would, admittedly, be conceivable to provide only one of the rotating elements with the cam track control mentioned and to fix the other directly on the shaft. This solution is, however, less favourable since the rotating piston machine can then no longer run evenly. Therefore, a cam track control is expediently provided for each rotating element.

If cylindrical rolling elements are chosen, they cannot roll correctly on the cam rings if there are varying distances and thus circumferential lengths of the cam tracks, but have to slide partially, which is accompanied by frictional losses.

It is expediently provided that the rolling elements taper conically on both sides and that the cam rings have, in radial and axial directions, rolling tracks following a given function.

In this way, it can be achieved by suitable choice of the functions that the rolling elements roll evenly and free from friction on the rolling tracks of the inner and of the outer cam ring and do not slide. The axial function for the rolling track is obtained in this case from the radial function. It must be ensured that, with a given rotation of the rolling element about a certain angle, the rolling element rolls on both tracks without sliding. This takes place by changing the effective rolling element diameter in as much as the track is arranged axially displaced at a point at which the effective rolling element diameter has the suitable value on account of the conical shape.

The rolling elements and the cam rings are expediently mirror-symmetrical with respect to a radial plane. As a result, the rolling elements always rest on two mirror-symmetrical parts of a double rolling track and cannot tilt.

If the cam rings are made up of two mirror-symmetrical halves, they can be produced particularly simply. Both cam ring halves then have (apart from the track shape) essentially frustoconical shape, so that the outer ring halves in particular can be produced more easily. In addition, in this way the entire arrangement can be assembled easily.

If the cam rings can at the same time be tensioned in axial direction by their being an intermediate space also provided between the cam ring halves, the cam ring halves can, by axial tension, be pressed firmly against the rolling elements, so that the entire arrangement is free from play. This tensioning effect in axial direction takes place advantageously by spring loading.

As already mentioned, two cam ring pairs have to be provided per rotating element. If it is provided that the one set of cam rings of the pair of sets are mirror-symmetrical with respect to a radial plane of the shaft, then the other pair of cam rings in said set can be fitted immediately adjacent to said first pair of cam rings, radially off set at 45 degrees with respect to said first pair of cam rings in order save space in an axial direction and reduce overall size. The balance is also better in these conditions. By using identical cam rings for both sets, the number of different cam rings also becomes very small. Only two outer cam ring halves and two inner cam ring halves have to be produced. As a result of the second set of cam rings being fitted the other way round, in other words that the function running in circumferential direction runs in precisely the opposite direction to that of the respectively other set, the continuous force transmission is made possible, so that whenever no force is transmitted by one set, this takes place by the other set.

It is advantageously provided that the vanes of the rotating elements have, in a plane containing the shaft axis, the shape of a square, the one diagonal of which is perpendicular to the shaft axis and that the casing consists of two halves, the parting line of which is the center plane of the annular space, the annular space can thus be produced particularly easily and the machine can be assembled very simply. If a flexible seal and a tensioning device are also provided between the two casing halves, a better sealing effect can be achieved by stronger clamping of the casing halves, since then the oblique casing halves bear very well against the surfaces of the rotating elements running at 45° to the shaft.

If it is additionally provided that the angular position of the cages with respect to the casing is variable, the position of the intake and discharge openings can also be changed. Although then the cyclic movement of the two rotating elements remains the same even with respect to each other, the rotating elements or the working spaces formed between them then coincide at different times with the intake and discharge openings, so that the mode of operation of the machine can be changed in a simple way.

In the case of an expedient embodiment, it is further provided that at least parts of the radially outer wall are formed by moveable, hollow elements which are provided with seals and which, if the contact pressure on the vanes subsides and there is therefore a poorer sealing effect, are again pressed firmly against the vanes by a leakage flow caused thereby. In this way, a very simple and expedient automatic regulation of the sealing effect between rotating elements and walls of the sealing space is obtained.

The rolling elements in the cages are expediently held with the aid of bearing shells or sliding blocks which are fixed in the cage with the aid of toothings in such a way that they can execute a rolling movement in one direction but are prevented from a movement in a direction perpendicular thereto.

In many cases, it will be arranged for the input drive, if the rotating piston machine is used as a compressor, or the output drive, if the rotating piston machine is used as an engine, to take place at the shaft. However, the two rotating elements or parts connected thereto can also be connected rigidly to the rotor of an engine/generator the stator of which is connected to the casing. In this advantageous embodiment, the input drive, in the case of use of the rotating piston machine as a compressor, does not act on the shaft, but directly on the two rotating elements. The driving speed can in this case be adapted very effectively to the changes in the rotational speed of the rotating elements, in particular with use of a disc-rotor engine. Then all that takes place via the shaft is the forced compensation or adaptation, controlled by the rolling elements and cam tracks, of the speeds of rotation of the two rotating elements. The same applies correspondingly if the rotating piston machine is used as an engine; in this case, the rotors of disc-rotor generators are rigidly connected to the rotating elements.

By the arrangement according to the invention of eight rolling elements per rotating element, which are arranged free from play, the rotating elements are borne effectively. As a result, in addition to the advantage already mentioned of quiet running and of high efficiency, it is also achieved that additional bearings for the rotating elements can be dispensed with completely.

The invention is described below by way of example using advantageous embodiments with reference to the attached drawings, in which:

FIG. 1 shows a section through a radial plane of the annular space with the two rotating elements;

FIG. 2*a–d* shows the two rotating elements in different positions:

FIG. 3*a–c* shows the principle of the cam track control according to the invention;

FIG. 4 shows a section in an axial plane of the shaft through inner cam ring, rolling element and outer cam ring;

FIG. 5 shows a view of rolling element and cage parts, seen radially from outside;

Figure 11:
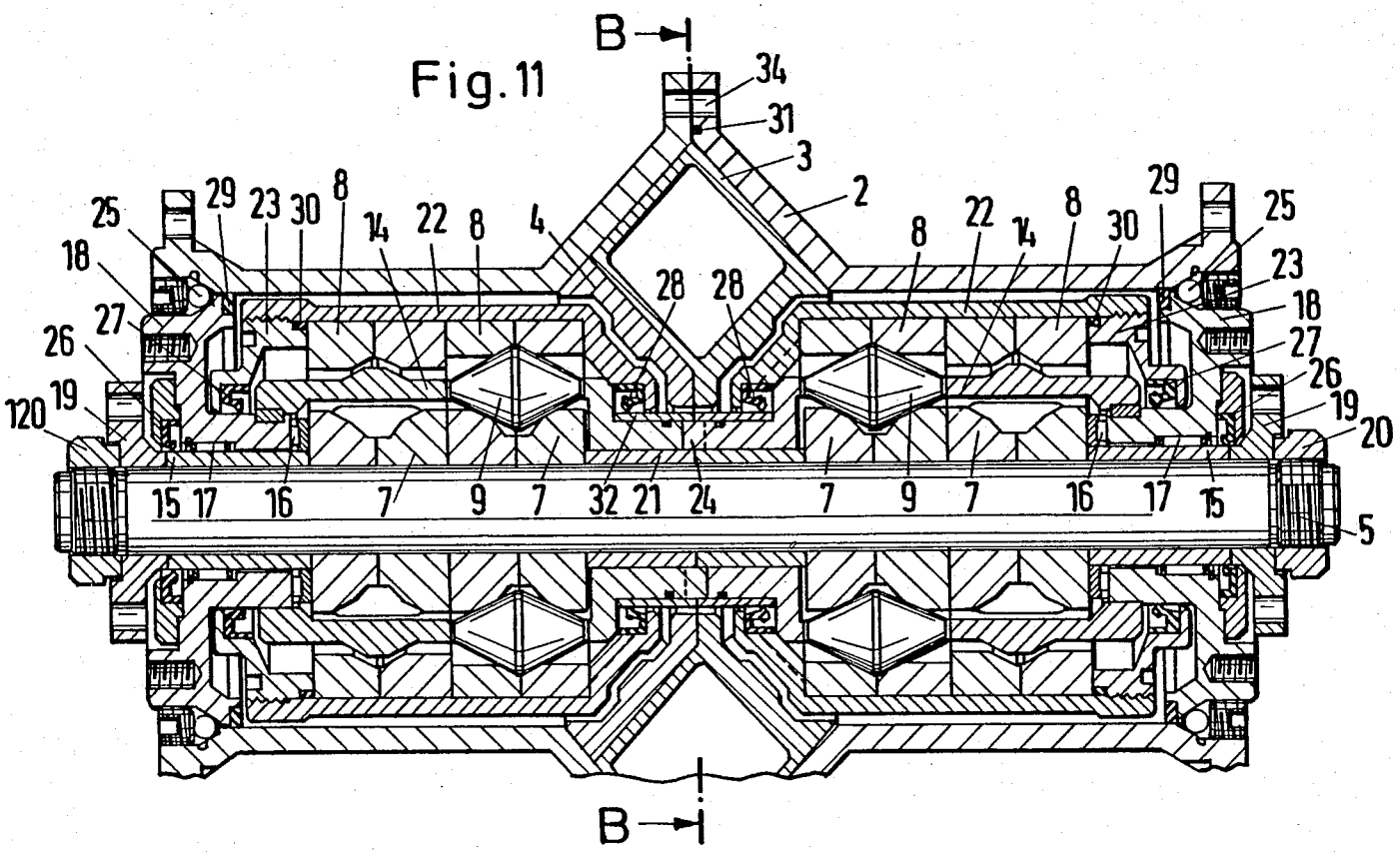
Figure 12:
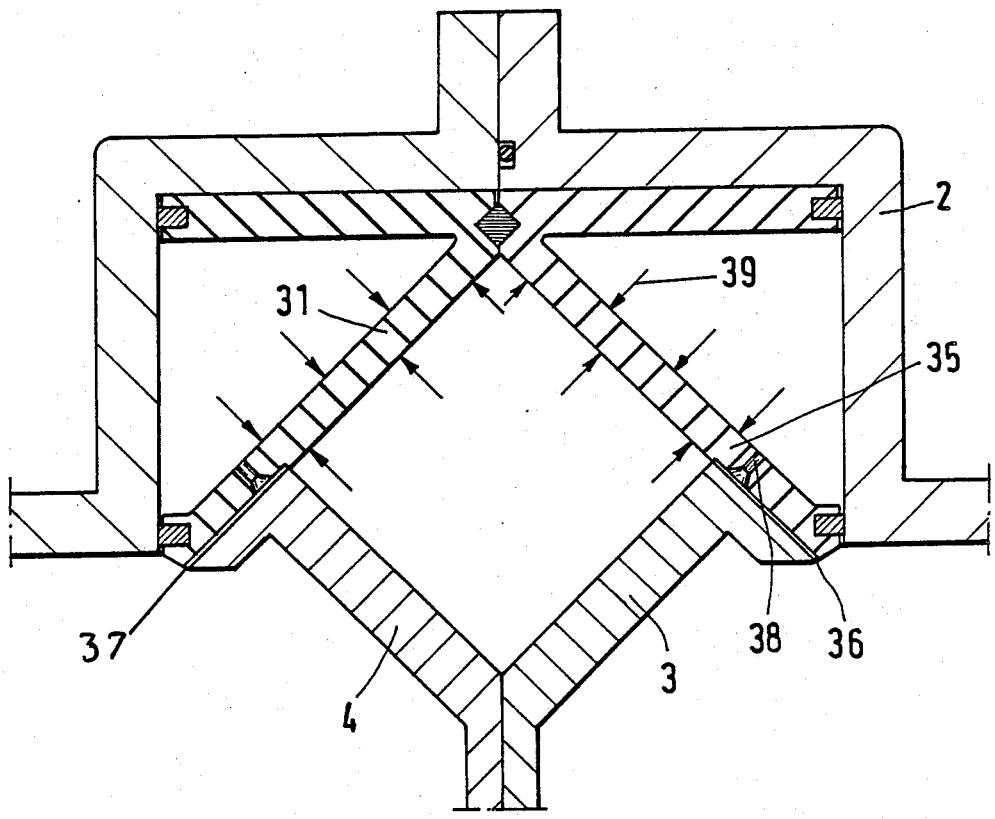
Figure 13:
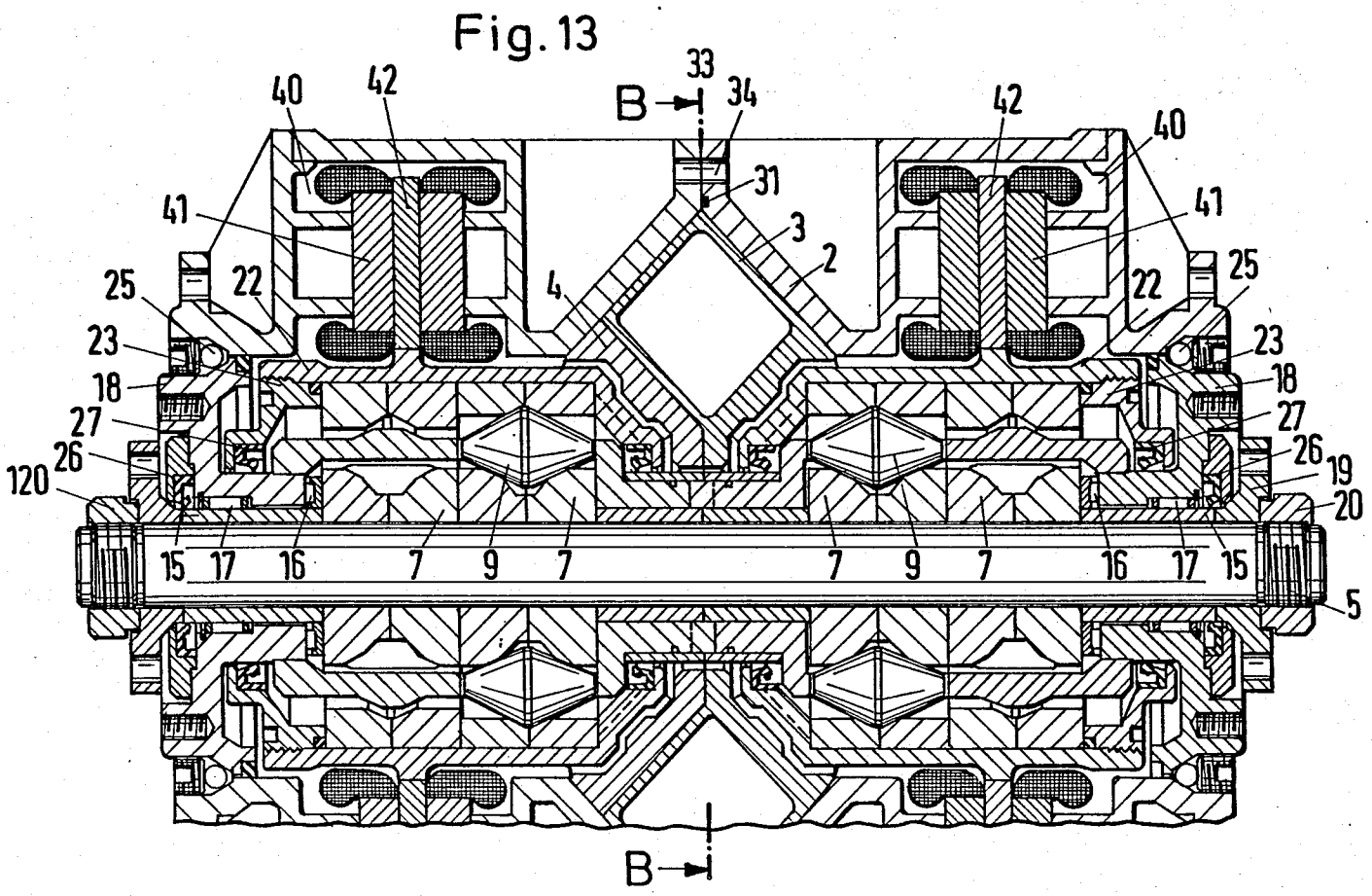

FIG. 10*a* and *b* shows details of the cage and of the rolling element guide in axial view;

FIG. 11 shows a section through the machine of the invention;

FIG. 12 shows an axial section through the annular working space in the case of a further embodiment of the invention; and FIG. 13 shows a further embodiment in similar representation to that of FIG. 11.

Figure 1:
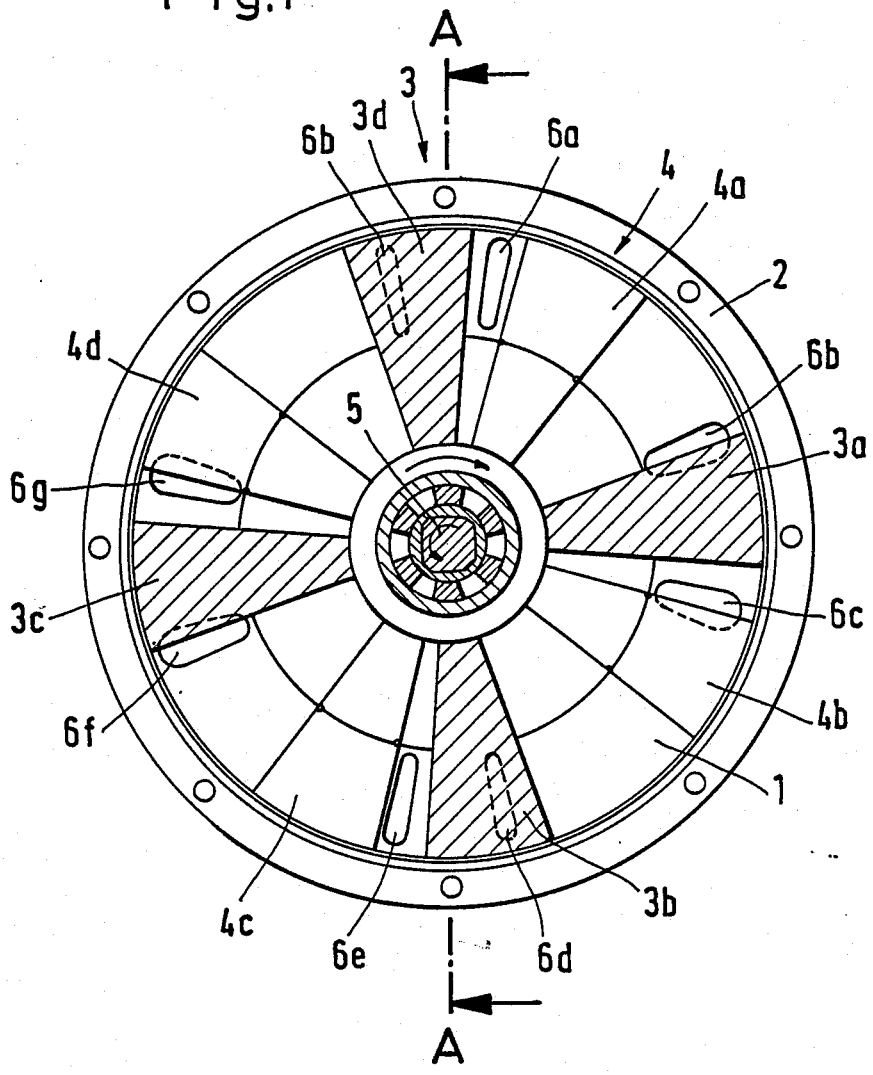
Figure 2D:
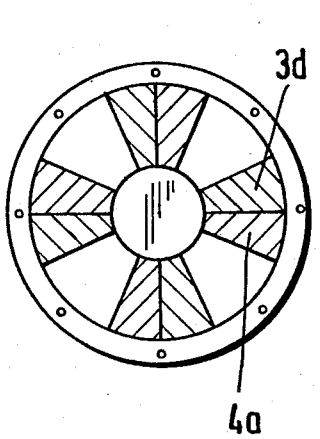
Figure 2C:
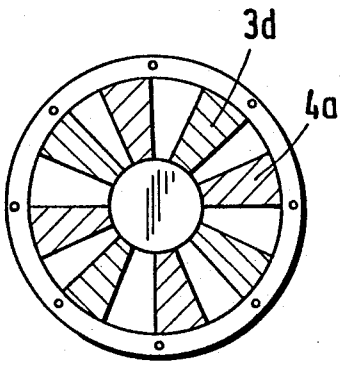
Figure 2B:
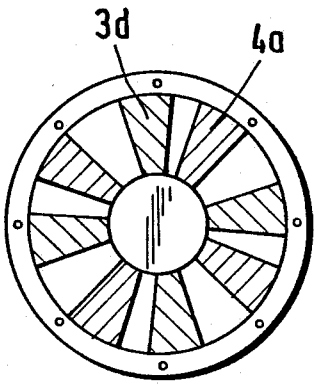
Figure 2A:
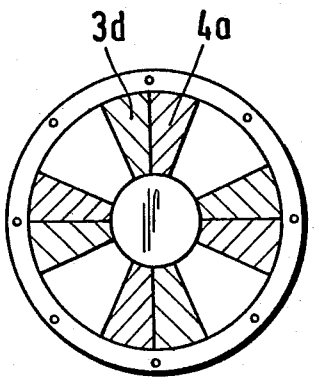

FIG. 1 shows the annular space 1, which is surrounded by parts of the casing 2. In the annular space 1 there are the two interengaging rotating elements, which are designed as impellers 3 and 4. The impeller 3 has in this case the vanes 3*a*, 3*b*, 3*c*, and 3*d* while the impeller 4 has the vanes 4*a*, 4*b*, 4*c*, and 4*d*. Both impellers are driven by a centrally arranged shaft 5, in a way yet to be described. 6*a*–6*h* denote various intake openings and discharge openings in the front wall of the annular space 1.

The mode of operation of this arrangement is as follows. If the shaft 5 moves anticlockwise, the impellers 3 and 4 are turned clockwise at different speeds in a way yet to be described. In the position shown, for example, the impeller 4 would turn faster clockwise than the impeller 3. In this case, the working space between the impellers 3*d* and 4*a* would increase, so that gas is sucked in through the intake port 6*a*. At a subsequent time, this intake port 6*a* is then closed by the slowly following vane 3*d*. From about this moment on, the vane 3*d* begins to move faster than the vane 4*a*, so that the working space between the two vanes is reduced and the gas is compressed until both vanes have moved so far that the working space is over the discharge opening 6*b*, so that the gas can escape here. At this time, the vane 3*d* can be moved up to the vane 4*a*, so that the gas is fully pressed out here.

This mode of operation can be used both for a compressor and for an internal-combustion engine. All that need be provided are combustion spaces, fuel lines, etc.

FIG. 2 shows four phases of the operating cycle just described. A new operating cycle commences after a 90° rotation of the two rotating elements.

Figure 3C:
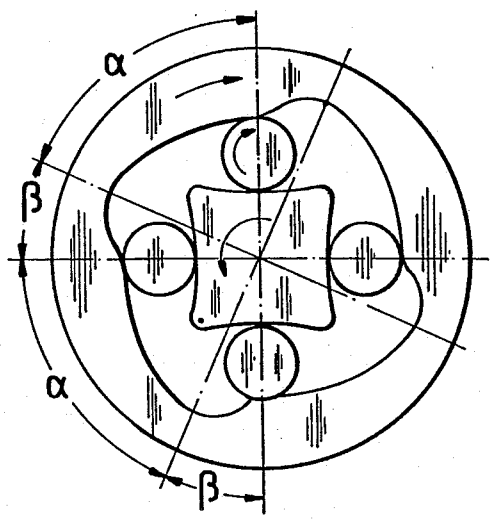
Figure 3B:
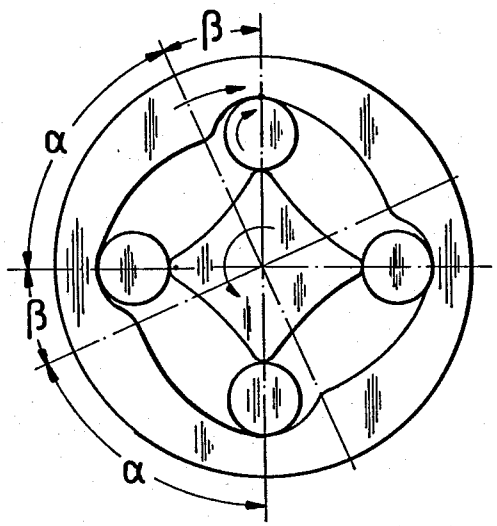
Figure 3A:
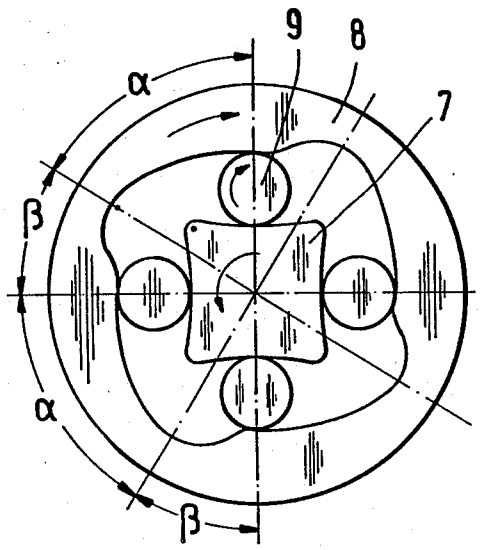

FIG. 3 then shows the principle of the cam track control according to the invention. Shown in the radial sections of FIG. 3, on the inside, is an inner cam ring 7 connected fixedly in terms of rotation to the shaft 5 and embraced on the outside by an outer cam ring 8, which is connected to the rotating elements 3, 4. Between the inner and outer cam track rings there are rolling elements 9 at 90° intervals. The said rolling elements are held firm with respect to the casing 2 by a cage in such a way that they can only perform a movement radially outwards or inwards, but no movement in the rotational direction of the shaft or of the inner and outer cam rings 7, 8.

If, as can be seen in the transition from the figure on the left of FIG. 3 to the center figure, the inner cam ring 7 turns anticlockwise, due to its outer contour, the rolling element 9 is pressed downwards. As a result, the outer cam ring 8 is then turned clockwise, since it must give way in this direction in order to create space for the rolling element 9. When the central position is reached, turning is continued by a corresponding movement on another set of inner cam ring, rolling elements and outer cam ring until the position on the right of FIG. 3 is reached, which again corresponds to the starting position on the left. In this way, the rotational movement of the shaft 5 is thus converted into a rotational movement of the rotating elements 3, 4 in the annular space, this rotational movement being uneven however and determined by the curve shape of the inner and outer cam rings 7, 8.

Angles alpha and beta shown in FIG. 3 have different magnitude and facilitate understanding the operation of the machine. When the shaft 5 with inner cam rings 7 rotates counter-clockwise 45° to the position shown in the left figure from a position wherein the peak of the inner cam ring portion indicated by the dot 15, the outer cam ring moves about an angle alpha greater than 45 degrees, as indicated by the displacement of the dot associated with outer cam ring 8 from the vertical to the position shown at the left. At a further rotation of the shaft about 45 degrees, as shown in the center figure, the outer cam ring 8 moves about an angle beta, which is smaller than alpha. Alpha and beta add to obtain an angle of rotation of 90 degrees. By the fact that alpha and beta are of different size, the smaller angular velocity of one rotor corresponds to a larger angular velocity of the other rotor. In this way, the volume of the chambers between the rotor vanes is periodically changed.

If the rolling elements 9 were cylindrical, they could not roll evenly on the inner and the outer cam ring 7, 8, but they would tend to slide since the track curves are different. This can now be avoided by the rolling elements 9 according to the invention in the shape of a double cone, as is shown in section in FIG. 4. There it can be seen that the rolling element 9 has various effective diameters during rolling. For instance, on the left at 10, an average rolling diameter for rolling on the outer cam ring 8 is shown, while on the right at 11 an average rolling diameter for rolling on the inner cam ring 7 is indicated. Average rolling diameters are referred to here, as obviously the contact surface between cam ring and rolling element is not a mathematical line but has a certain width.

As is shown in the figure, the cam rings 7 and 8 are not designed in one piece, rather they consist of two cam ring halves 7*a* and 7*b* and 8*a* and 8*b* respectively, which are of mirror-symmetrical design. Only in the region of the rolling track 7*c* and 8*c* respectively is the rolling element 9 in contact with these cam ring halves.

The rolling elements are held in a cage, which must be imagined in FIG. 4 in front of and behind the rotating element 9. This cage, or part of it, is shown in plan view in FIG. 5.

The rolling elements 9 are held by two bearing shells 12, in which the rolling element can turn slidingly. The bearing shells have, on the outside, a toothing which engages in a corresponding toothed rack 13 of the cage 14. In this way, the rolling element 9 can indeed move forwards or backwards in FIG. 5, i.e. in the case of the rotating piston machine in radial direction, or upwards or downwards in FIG. 4. However, it is hindered from an angular movement with respect to the casing, i.e. a movement to the right or left in the case of the representation of FIG. 5.

Figure 6:
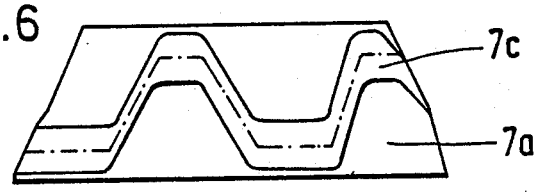
FIG. 6 shows a side view of the inner cam ring.
Figure 7:
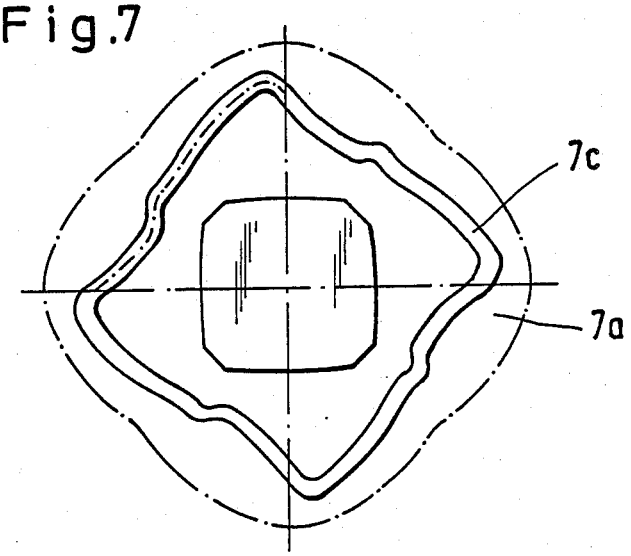
FIG. 7 shows the cam ring of FIG. 6 in plan view.

FIG. 6 shows a cam inner ring half 7*a* in side view;

FIG. 7 shows the same cam ring half 7*a* in plan view.

The essentially obliquely running outer surface can be seen there, which is arranged in the shape of a truncated cone on which the rolling track 7*c* for the rolling element 9 is then provided as the raised portion.

As can be seen from FIGS. 6 and 7, the rolling track 7*c* passes, both in radial direction and in axial direction, through a function which corresponds to the desired track control behaviour.

Figure 8:
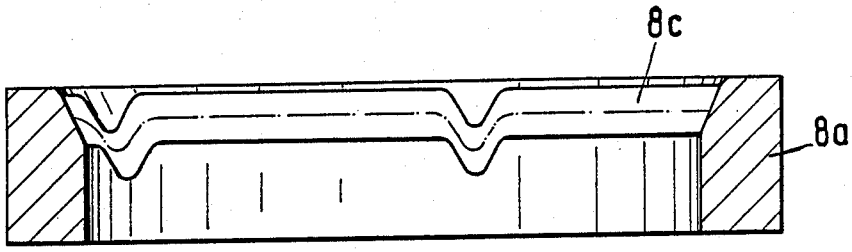
FIG. 8 shows a side view of the outer cam ring.
Figure 9:
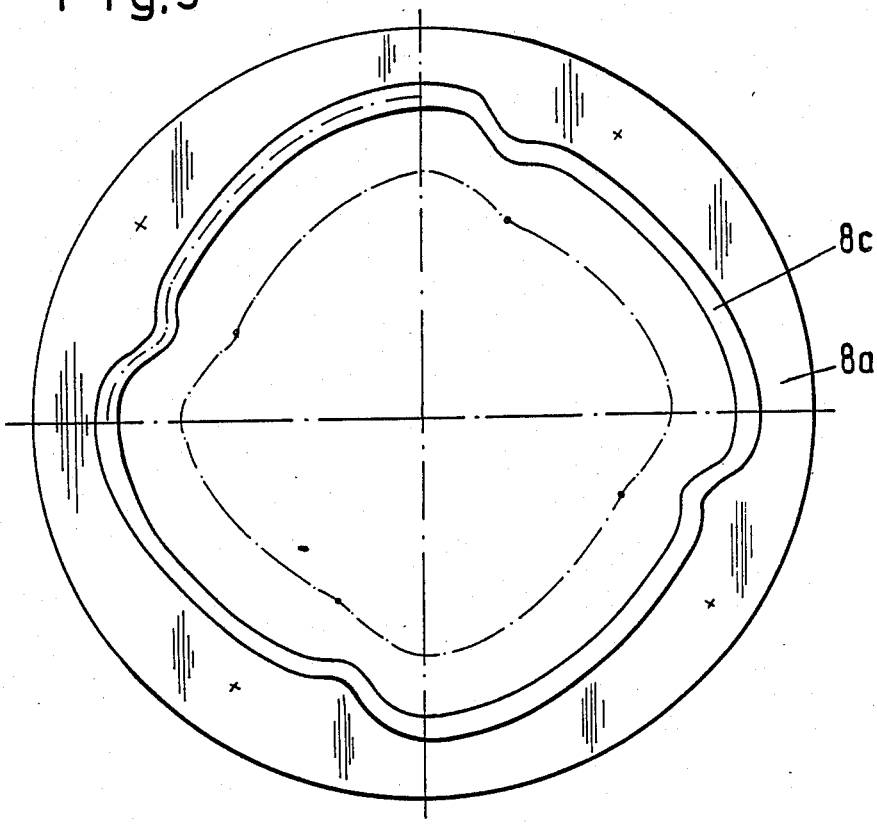
FIG. 9 shows the cam ring of FIG. 8 in plan view.

FIGS. 8 and 9 correspondingly show a section through an outer cam ring half 8*a* FIG. 8 and a plan view FIG. 9. The elevated rolling track 8*c* can also be recognized there.

FIG. 10 shows once again in more detail, in axial view partially cut away, the bearing of the rolling elements 9 in the cage 14. The cam rings with the rolling tracks are also indicated there.

FIG. 11 shows, in an axial section, the machine according to the invention. The drive shaft 5 is rotatably borne in the casing 2 by means of distance sleeves 15 and radial and axial bearings 16, 17 and casing flanges 18. On the right side of the right distance sleeve 15, there further adjoins a coupling flange 19 and a nut 20. On the left side of the distance sleeve 15 there adjoin the two pairs of inner cam rings, which are intended for the drive of rotating element 3. There then adjoins to the left of these two pairs of inner cam rings a distance sleeve 21, which then extends to the corresponding inner rings 7 on the left side, which are intended for the drive of the other of the two rotating elements, i.e., rotating element 4.

By tightening of the nut 20, the two halves of the inner cam rings 7 are pushed together via the distance sleeves 15 and 21 and by a corresponding counter-pressure element 120 on the left side of the machine, so that the rolling elements 9 are pressed outwards, to bear firmly against the outer rings 8. These likewise consist of two halves and are arranged fixedly in terms of rotation in jacket sleeves 22 which are connected to the rotating elements 3 and 4, respectively. Sealing flanges 23 not only hold the outer cam rings 8 firmly, but also push them against each other in order to create a counter-pressure here for the pressure of the rolling elements 9. The pushing together of the halves of the inner rings 7 or outer rings 8 may also take place here by means of spring elements (not shown).

The ages 14 in which the rolling elements 9 are borne, are finally fixed on the respective casing flanges 18 and connected fixedly in terms of rotation to the cage 14 on the other side of the arrangement by means of a rack toothing 24. In this way, the cages are secured in circumferential direction against the casing. The angular setting of the cages 14 with respect to the casing 2 may also be changed by changing the angular setting of the casing flange 18 with respect to the casing tube by an adjusting bearing 25.

At 26–30, further seals are shown, and at 31 a further seal between the casing halves is provided. Finally, 32 is a sliding sleeve between cage 14 and rotor 3 and between cage 14 and rotor 4, respectively.

As stated, the casing 2 is made up of two halves, the seal 31 being provided at the parting line 33 of the same. If the sealing effect between the vanes of the rotating elements 3, 4 and the wall of the annular space 1 becomes inferior, by tightening of a bolt inserted through the bore 34, it can be effected that the two casing halves are moved closer together, producing a better contact between casing walls and rotating elements 3, 4 in the annular space, as a result of which the sealing effect is improved.

In the case of the embodiment of FIG. 12, the vanes just out of sight in FIG. 12 of the rotating element 3 and 4 are not directly in contact with the casing wall 2, but with a wall element 35 which is bourne in a flexible and sealing manner. If said wall element 35 yields, a sealing gap 36 between rotating element 3 and element 35 widens or a corresponding sealing gap between rotating element 4 and a corresponding element 37, which corresponds to the element 35 widens. As a result, gas under pressure here enters the sealing gap 36 and correspondingly on the other side and can pass through an opening 38 into the cavity behind the element 35 and thereby press the latter in the direction of the arrows 39 inwards against the vanes of the rotating elements. In this way, an automatic regulation of the sealing effect is achieved.

In the case of the embodiment of FIG. 13, the rotors 42 of engines or generators 40 are connected directly to the rotating elements 3, 4. FIG. 13 shows that the rotor 42 of the engine/generator on the right hand side is connected rigidly to the rotating element 3 via the jacket sleeve 22. The same applies correspondingly for the second engine/generator 40 which is rigidly connected to the rotating element 4. The stator 41 of said engines/generators is in this case rigidly connected to the casing 2. In the case of this embodiment, the input/output drive no longer takes place via the shaft. Rather, the rotating elements 3, 4 are driven directly by the engines 40, or the rotating elements 3, 4 drive the generators 40 directly, but forcibly control coordination of the movements of the rotating elements 3 and 4 then taking place via the shaft 5.

I claim:

1. A rotating piston machine for use with a working medium comprising:

a casing (2) having wall structure in which a plurality of spaced apart intake and discharge openings (6*a*, 6*b*) are provided for the working medium;

a shaft (5) supported within the casing and defining an annular space (1) between the shaft and the casing:

first and second rotating elements (3, 4) in driving relationship with the shaft and bearing sealingly against the casing wall for rotation therein, each rotating element having four sector-shaped vanes extending radially relative to the shaft and the two rotating elements being arranged coaxially with each vane of one rotating element located between two vanes of the other rotating element;

first and second cam track control means (7, 8, 9) operatively connected between the shaft and one of the rotating elements, for cyclically imparting variations in the relative speed of rotation of the rotating elements and in the distances between adjacent vanes of the rotating elements upon rotation relative to the shaft, each cam track control means including, an inner cam ring (7) which is connected for corotation with the shaft, an outer cam ring (8) which is connected for corotation with said one of the rotating elements, four rolling elements (9) situated between the inner cam ring and the outer cam ring, each rolling element interacting with the cam rings so as to be movable radially relative to the shaft; and cage means (14) connected to the casing, for holding the rolling elements of the first and second cam track control means against displacement in the circumferential direction relative to the shaft.

2. Rotating piston machine according to claim 1, wherein the first and second cam track control means are structurally identical but oriented so that the rolling elements (9) of the cam rings (7, 8) of the first track control means are arranged offset by 45° with respect to the cam rings (7, 8) of the second track control means.

3. Rotating piston machine according to claim 1, characterised in that the vanes (3*a*–3*d*, 4*a*–4*d*) of the rotating elements (3, 4) have, in a plane containing the shaft axis, the cross-sectional shape of a square, the one diagonal of which is perpendicular to the shaft axis, and in that the casing (2) consists of two halves, the parting line (33) of which is the center plane of the annular space (1).

4. Rotating piston machine according to claim 1, characterised in that the angular position of the cages (14) is variable with respect to the casing (2).

5. Rotating piston machine according to claim 1, characterised in that at least parts of the radially outer wall of the annular space (1) are formed by moveable, hollow elements (35) which are provided with seals and which, if the contact pressure on the vanes subsides and there is therefore a poorer sealing effect, are pressed back firmly against the vanes by a leakage flow caused thereby.

6. Rotating piston machine according to claim 1, characterised in that the rolling elements (9) are held in the cages (14) with the aid of bearing shells or sliding blocks (12), which are fixed in the cage (14) with the aid of toothings (13) in such a way that they can execute a rolling movement in one direction.

7. Rotating piston machine according to claim 1, wherein each inner cam ring is formed by a pair of inner cam ring segments (7*a*, 7*b*) and each outer cam ring is formed by a pair of outer cam ring segments (8*a*, 8*b*).

8. Rotating piston machine according to claim 1, wherein the machine forms a part of a power generation device having a rotor pair and stator, the rotor being rigidly connected to a rotation element (3, 4) and the stator being connected to the casing (2).

9. Rotating piston machine according to claim 8, wherein the rotors are disc-type rotors.

10. Rotating piston machine according to claim 1 including, third and fourth cam track control means operatively connected between the shaft and the other of the rotating elements, the third and fourth cam track control means having the same structural and functional relation to the shaft and to the other of the rotating element as the first and second cam track control means have to the shaft and to said one of the rotating elements, and wherein the cage means includes means for holding the rolling elements of the third and fourth cam track control means against displacement in the circumferential direction relative to the shaft.

11. Rotating piston machine according to claim 10, wherein the rolling elements (9) taper conically on both sides and the cam rings (7, 8) have, in radial and axial direction, rolling tracks (7*c*, 8*c*) following a given function.

12. Rotating piston machine according to claim 10, wherein the rolling elements (9) and the cam rings (7, 8) of each cam track control means are mirror symmetric with respect to a radial plane of the shaft (5).

13. Rotating piston machine according to claim 10, wherein the rolling elements (9) are held in the cages (14) with the aid of bearing shelves or sliding blocks (12), which are fixed in the cage (14) with the aid of teeth (13) in such a way that the element can execute a rolling movement in one direction.

14. Rotating piston machine according to claim 10, wherein for each of the first, second, third and fourth cam track control means are structurally identical but oriented so the rolling elements of the cam rings of the first track control means are arranged offset by 45° with respect to the cam rings of the second track control means, and the rolling elements of the cam rings of the third track control rings are arranged offset by 45° with respect to the cam rings of the fourth track control means.

15. Rotating piston machine according to claim 10, wherein each inner cam ring is formed by a pair of inner cam ring segments (7*a*, 7*b*) and each outer cam ring is formed by a pair of outer cam ring segments (8*a*, 8*b*).

16. Rotating piston machine according to claim 1, characterised in that the rolling elements (9) taper conically on both sides and in that the cam rings (7, 8) have, in radial and axial direction, rolling tracks (7*c*, 8*c*) following a given function.

17. Rotating piston machine according to claim 16, wherein the rolling elements (9) and the cam rings (7, 8) of each cam track control means are mirror symmetric with respect to a radial plane of the shaft (5).

18. Rotating piston machine according to claim 17, characterised in that the cam rings (7, 8) are made up of two mirror symmetrical halves (7*a*, 7*b*; 8*a*, 8*b*).

19. Rotating piston machine according to claim 18, including means for tensioning all the cam rings (7, 8) in the axial direction.

20. Rotating piston machine according to claim 19, characterised in that the cam rings (7, 8) are spring loaded in axial direction.

* * * * *